US006139007A

United States Patent [19]

Cahill et al.

[11] Patent Number: 6,139,007

[45] Date of Patent: Oct. 31, 2000

[54] SHEET SEPARATOR DAM WITH BUCKLING ELEMENT

[75] Inventors: Daniel Paul Cahill, Verona; Robert Joseph Feldman, Midway; Sishuang Li, Lexington, all of Ky.; Adam Gordon Price, Carmel, Ind.; Richard Gayle Snapp, Carlisle, Ky.; Scott Stephen Williams, Versailles, Ky.; Curtis Duane Woodson, Georgetown, Ky.

[73] Assignee: Lexmark International, Inc., Lexington, Ky.

[21] Appl. No.: 09/425,536

[22] Filed: Oct. 22, 1999

[51] Int. Cl.[7] ..... B65H 3/52

[52] U.S. Cl. ..... 271/121; 271/167

[58] Field of Search ..... 271/121, 167, 271/137

[56] References Cited

U.S. PATENT DOCUMENTS

| | | | |
|---|---|---|---|
| 1,505,349 | 8/1924 | Johnson et al. | 271/167 |
| 3,126,122 | 3/1964 | Sacre . | |
| 3,640,524 | 2/1972 | Fredrickson . | |
| 3,871,641 | 3/1975 | Marx et al. . | |
| 5,527,026 | 6/1996 | Padget et al. . | |
| 5,868,385 | 2/1999 | Embry et al. . | |
| 5,879,003 | 3/1999 | Kovach et al. | 271/121 |
| 5,895,040 | 4/1999 | Oleska et al. . | |
| 5,899,450 | 5/1999 | Gettelfinger et al. . | |
| 6,065,886 | 5/2000 | Embry et al. | 271/167 X |

*Primary Examiner*—David H. Bollinger
*Attorney, Agent, or Firm*—John A. Brady

[57] ABSTRACT

A dam has a slat disposed therein with protrusions along its sheet-engaging surface. If more than one sheet is fed from a stack to the dam, the sheets strike the slat surface and protrusions, causing the sheets to buckle and then separate from each other.

62 Claims, 6 Drawing Sheets

SHEET SEPARATOR DAM WITH BUCKLING ELEMENT

CROSS-REFERENCE TO RELATED APPLICATIONS

Reference is made to co-pending application Ser. No. 09/385,920, filed Aug. 30, 1999, and assigned to the assignee of the present application.

FIELD OF THE INVENTION

This invention relates to a sheet separator for separating adjacent sheets of media being fed from a stack of sheets so that only one sheet is fed to a process station and, more particularly, to a dam separator separating the uppermost or top sheet of a stack of sheets from the next adjacent sheet during feeding of the top sheet from the stack of sheets of media.

BACKGROUND OF THE INVENTION

One problem in feeding a top or bottom sheet of media from a stack of sheets of media is that the sheets may stick together and at least the next adjacent sheet may be fed at the same time. Accordingly, various separating means have been suggested for separating a top sheet of a stack of sheets of media from the next adjacent sheet when the feed is from the top of the stack of sheets of media and for separating a bottom sheet of a stack of sheets of media from the next adjacent sheet when the feed is from the bottom of the stack of sheets of media. This problem is particularly acute when feeding labels, as labels are formed on a thick medium with numerous ridges and valleys that interlock from one sheet to the next, causing the sheets to stick together. Also, certain label materials, such as vinyl, tend to stick together.

It is known to separate a top sheet of a stack of sheets from the next adjacent sheet through using a dam, which is an element having an inclined surface in the path of the top sheet, as it is fed from the stack of sheets, so that its leading edge will strike the inclined surface of the element. In a printer, however, the advancement of more than one sheet from the stack of sheets can cause jamming. Therefore, it is necessary to avoid simultaneous advancement of more than one sheet from a stack of sheets of media to a processing station such as a printer, for example.

U.S. Pat. No. 5,899,450 to Gettelfinger et al. discloses a sheet separator dam with a plurality of ribs and an inset friction element, such as a pad. The pad surface has a coefficient of friction substantially equal to the sheet to sheet friction. If more than one sheet is fed from a stack to the dam, the sheets strike the rib surfaces of the dam first, and then the pad surface, if not separated from each other by the rib surfaces. The frictional step function separates the top sheet from the next adjacent sheet. In such an arrangement, however, the pad must be made of a material having a high coefficient of friction, such as rubber or a special plastic, which is relatively expensive. The pad wears in time and must be replaced at substantial expense and inconvenience. Also, a rubber pad may mar bond paper and leave an undesirable black mark. Still further, this arrangement does not reliably separate the top sheet where the sheets have unusual characteristics, such as labels.

One proposed solution for separating adjacent sheets of media with unusual characteristics, such as labels, has been the provision of protrusions or bumps along the surface of slats disposed in the dam. The bumps are formed in an alternating pattern of single and double bumps along each of four slats. The advancing sheets bump into the protrusions, causing the sheets to separate. However, the provision of too many bumps, so that the sheets engage more than one bump at a time, causes the sheets to stall, thus creating misfeeds. If the bumps are formed of differing, non-uniform sizes, as with a hammerless hole punch, some of the bumps are too large, also causing the advancing sheets to stall.

SUMMARY OF THE INVENTION

The sheet separator of the present invention overcomes the foregoing problems through successfully separating media with special characteristics, such as labels, with a dam having an inclined surface. The sheet separator of the present invention accomplishes this through having slats disposed within the dam. Preferably, one of the slats is formed with a plurality of rows of protrusions or bumps therealong, with the protrusions arranged so that only one bump at a time engages the sheets to cause them momentarily to buckle and then separate.

An object of this invention is to provide a sheet separator having a minimum of parts that wear.

Another object of this invention is to provide a sheet separator that is simple to construct.

A still further object of this invention is to provide a sheet separator that is simple and inexpensive to maintain.

An even further object of this invention is to provide a sheet separator that does not mar the surface of sheets fed therethrough.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
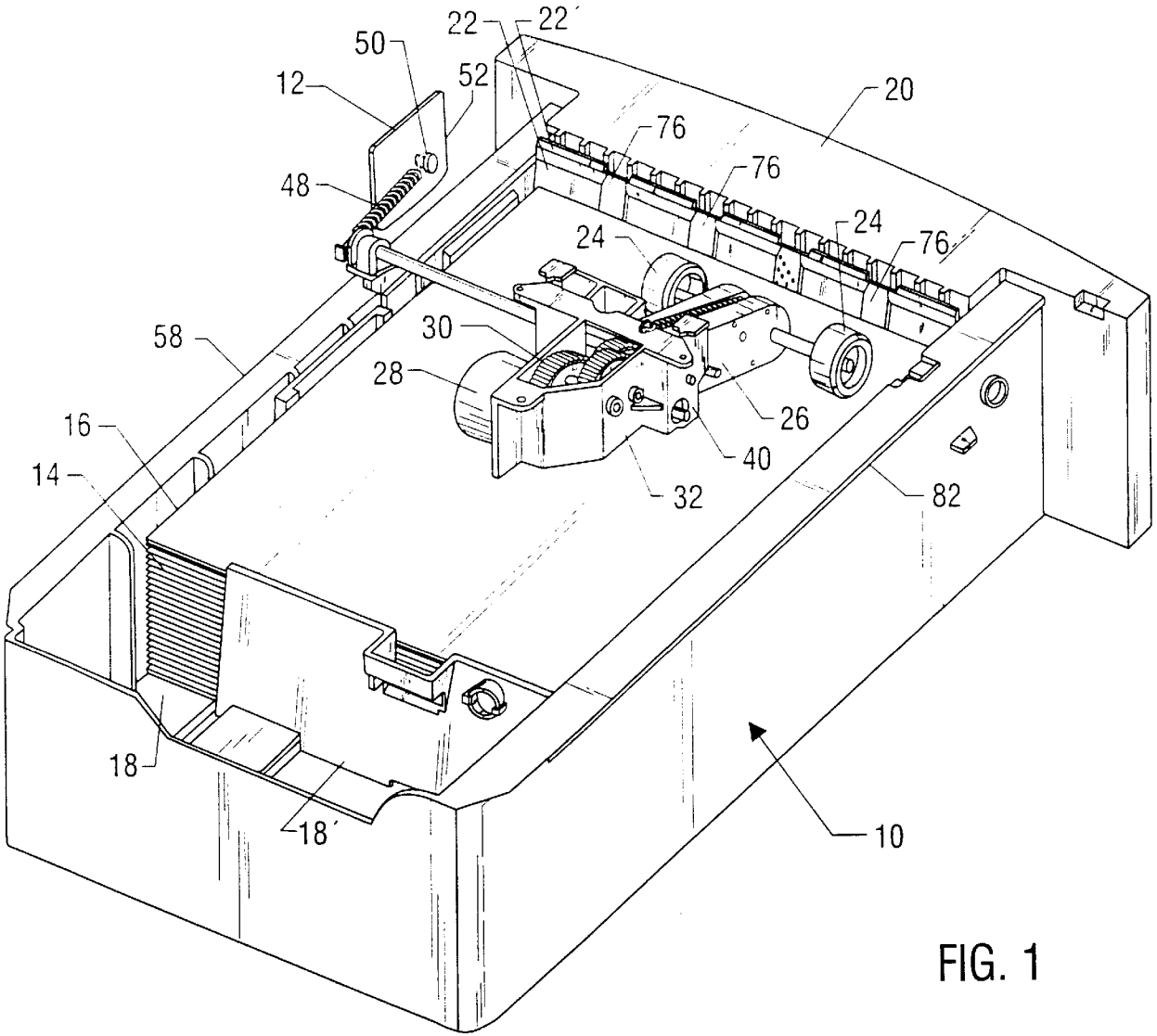
FIG. 1 is a perspective view of a printer tray having a sheet separator of the present invention with a stack of sheets of media therein and shown enlarged for clarity purposes.
Figure 2:
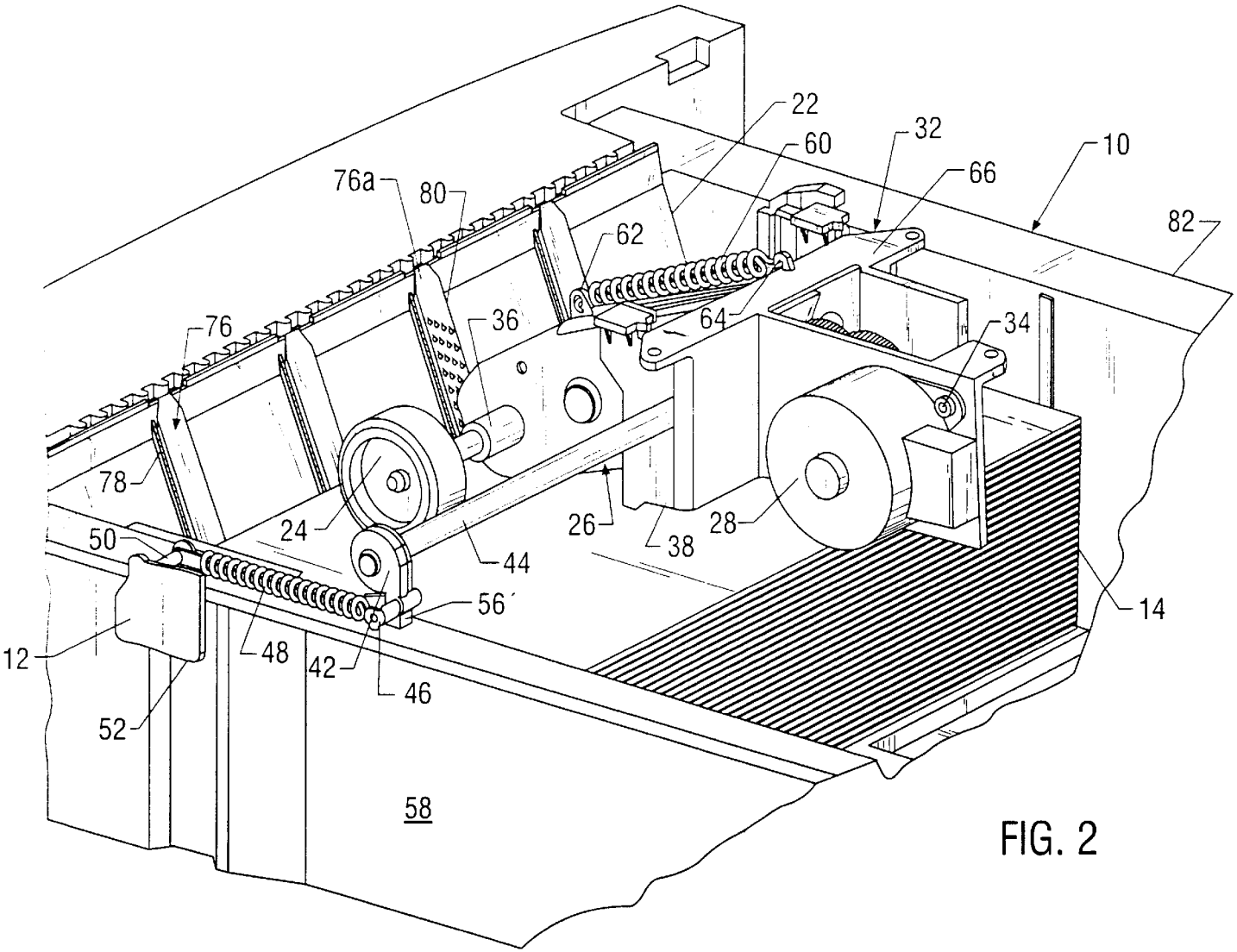
FIG. 2 is an enlarged perspective view of a portion of the tray of FIG. 1 and taken from the opposite side of FIG. 1.

Referring to the drawings, and particularly to FIG. 1 thereof, there is shown a tray 10 used in a printer 12. The tray 10 supports a plurality of sheets 14 of a media such as bond paper, for example, in a stack 16. The sheets 14 may be other media such as labels or envelopes, for example. Except for modifications of the dam surface with protrusions or bumps as will be described, sheet feeding is as described in U.S. Pat. No. 5,932,313 to Barton.

The tray 10 has a bottom surface or wall 18 supporting the stack 16 of the sheets 14 therein. The tray 10 has a rear restraint 18' abutting a trailing edge of each of the sheets 14 of the stack 16. Adjacent its front end 20, the tray 10 has an inclined surface or wall 22 integral with the bottom surface 18 of the tray 10.

The surface 22 is inclined at an obtuse angle to the bottom surface 18 of the tray 10 and to the adjacent end of the stack 16 of the sheets 14. In one embodiment, it was 19.5° from the vertical. The inclined or angled surface 22 constitutes a portion of a dam against which each of the sheets 14 in the stack 16 is advanced into engagement. The dam also includes a vertical surface 22' above the inclined surface 22. The sheet 14 is advanced from the vertical surface 22' towards a processing station (not shown) of the printer 12 at which printing occurs.

Each of the sheets 14 is advanced from the stack 16 of the sheets 14 by a pair of feed rollers 24, which are rotatably mounted on a pivotally mounted arm 26. The feed rollers 24 are driven from a motor 28 through a gear drive train 30. The motor 28 is alternately turned off and on by control means (not shown) as each of the sheets 14 is advanced from the top of the stack 16 of the sheets 14.

The motor 28 is supported on a bracket 32 by screws 34 (one shown). The bracket 32 is fixed to a sheet metal portion of the printer 12.

The pivotally mounted arm 26 has a sleeve 36 fixed thereto. The sleeve 36 is rotatably supported by a pair of substantially parallel vertical walls 38 and 40 of the bracket 32 through a pivot shaft 44 extending through the walls 38 and 40 and being rotatably supported thereby.

A bellcrank 42 is mounted on one end of the pivot shaft 44 and fixed thereto. The bellcrank 42 has a spring connector 46 fixed thereto and to which one end of a spring 48 is secured. The spring 48 has its other end connected to a post 50 (see FIG. 1) extending from a side frame 52 of the printer 12.

The spring 48 continuously urges the bellcrank 42 clockwise to hold the pivotally mounted arm 26 in a raised position in which the feed rollers 24 cannot engage a top sheet 54 (see FIG. 9) of the stack 16 (see FIG. 1). This occurs when the tray 10 is removed from the printer 12.

When the tray 10 is inserted within the printer 12, a vertical wall 56 extending upwardly from a side wall 58 of the tray 10 engages the bellcrank 42 to rotate the bellcrank 42 counterclockwise against the force of the spring 48. This counterclockwise rotation of the bellcrank 42 causes counterclockwise rotation of the pivot shaft 44, which has the bellcrank 42 fixed thereto. The pivotally mounted arm 26 then pivots counterclockwise because of gravity so that the feed rollers 24 engage the top of the stack 16 (see FIG. 1) of the sheets 14.

A counterbalance spring 60 extends between an ear 62 on the pivotally mounted arm 26 and an ear 64 in a flat portion 66 of the bracket 32. The counterbalance spring 60 limits the force applied by the feed rollers 24 to the top of the sheets 14 (see FIG. 1) in the stack 16.

When the feed rollers 24 are in the feed or sheet advance position in which they engage the top sheet 54 (see FIG. 9) of the stack 16 (see FIG. 1) of the sheets 14, the top sheet 54 (see FIG. 9) of the stack 16 (see FIG. 1) is advanced by rotation of the feed rollers 24 through energization of the motor 28. This causes leading edge 68 (see FIG. 9) of the top sheet 54 to engage the inclined surface 22 (see FIG. 1) of the tray 10, which is preferably formed of plastic.

Figure 10:
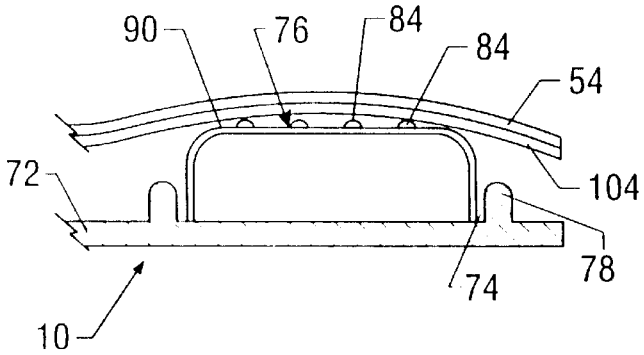
FIG. 10 is an enlarged fragmentary schematic sectional view of a portion of the dam of FIG. 1 showing two adjacent contacting sheets striking the slat surface of the dam to separate the two sheets, with the sheets shown enlarged for clarity purposes.

The inclined surface 22 includes a plurality of substantially parallel portions or ribs 70 (see FIG. 3) protruding from a base surface 72 (see FIG. 10). Each of the protruding portions or ribs 70 of the inclined surface 22 has a recess 74 (see FIG. 10) therein to receive a slat or slide 76 protruding beyond extensions 78 (see FIG. 10) of each of the protruding portions 70 of the inclined surface 22. The extensions 78 are positioned on each side of each of the plurality of substantially parallel slats 76 to form the side walls of each of the recesses 74 in the tray 10 in which the slats 76 are retained.

A recess 80 is formed in the inclined surface 22 between each adjacent pairs of the protruding portions or ribs 70. The recesses 80 also are formed in the inclined surface 22 between one of the outermost of the protruding portions or ribs 70 and the side wall 58 (see FIG. 1) of the tray 10 and between the other of the outermost of the protruding portions 70 (see FIG. 10) and a side wall 82 (see FIG. 1) of the tray 10.

Only a single slat **76*a* of the four slats 76 depicted in FIG. 1 has a plurality of protrusions or bumps 84 formed thereon. The protrusions 84 function as buckling elements for the sheets 14 as the sheets 14 are fed from the stack 16 to the printing station (not shown), as will be described more fully hereinbelow. The slat 76*a* is generally positioned between the feed rollers 24, as seen along a path parallel to the paper feed direction F (see FIG. 8). With certain media, such as paper from Far Eastern countries such as China, the slat 76*a* with the protrusions 84 may preferably be positioned adjacent the side wall 82 of the tray 10**.

Figure 3:
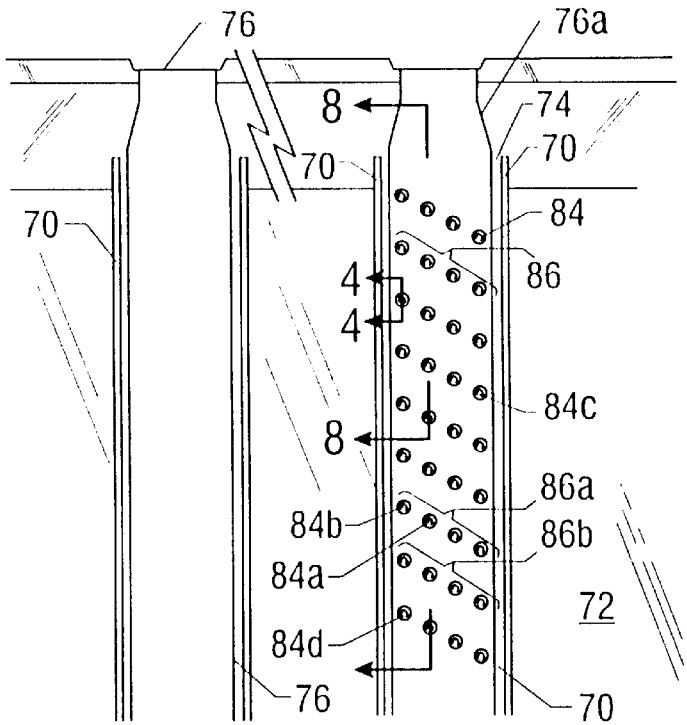
FIG. 3 is an enlarged fragmentary plan view of a portion of the dam of FIG. 1 showing a slat with bumps or protrusions thereon inserted in the parallel ribs of the dam.

The protrusions 84 on the slat **76*a* of FIG. 3 are arranged in a plurality of parallel rows 86, which are diagonal to the feed direction F. The parallel rows 86 can be arranged at any diagonal angle to the feed direction F, ranging from greater than 0° to less than 90°, depending upon the number of protrusions 84 in each row 86, as described hereinbelow. In the embodiment of FIG. 3, each row 86 is formed with four protrusions 84 in each row 86. The number four of protrusions 84 has been found to be very effective in preventing misfeeds of media such as paper in the printer 12. A larger or smaller number of protrusions 84** may be also be used, and the invention will function as described herein.

Each of the rows 86 is located a predetermined distance from each other on the slat **76*a* so that the protrusions 84 are evenly spaced in the feed direction F. Referring in detail to the exemplary rows 86*a* and 86*b* (see FIGS. 3, 4 and 5), the protrusions 84 are substantially circular in cross-section, and have centers 88. Lines from the centers 88, when projected onto a line L parallel to the feed direction F, are evenly spaced in the direction of the feed direction F. That is to say, the distance D along the line L from one protrusion 84*a* in the diagonal row 86*a* to the adjacent protrusion 84*b* is the same as the lateral distance D from protrusion 84*b* in the diagonal row 86*b* to the protrusion 84*c* in the diagonal row 86*b*. In addition, the lateral distance from one protrusion 84** to one in the adjacent row is also the distance D.

One suitable example of the material of the slats 76, **76*a* is stainless steel of quarter temper to half temper hardness, with an approximate thickness of 0.25 mm. One suitable coating on the exterior surface 90 of the slats 76, 76***a* is TEFLON® fluoropolymer, a low coefficient of friction material. The exterior surface 90 of each of the slats 76, 76*a* has a coefficient of friction of less than 0.15 with respect to paper. Each protrusion 84 formed on the slat 76*a* of FIG. 3 is of approximately uniform size and configuration.

Figure 4:
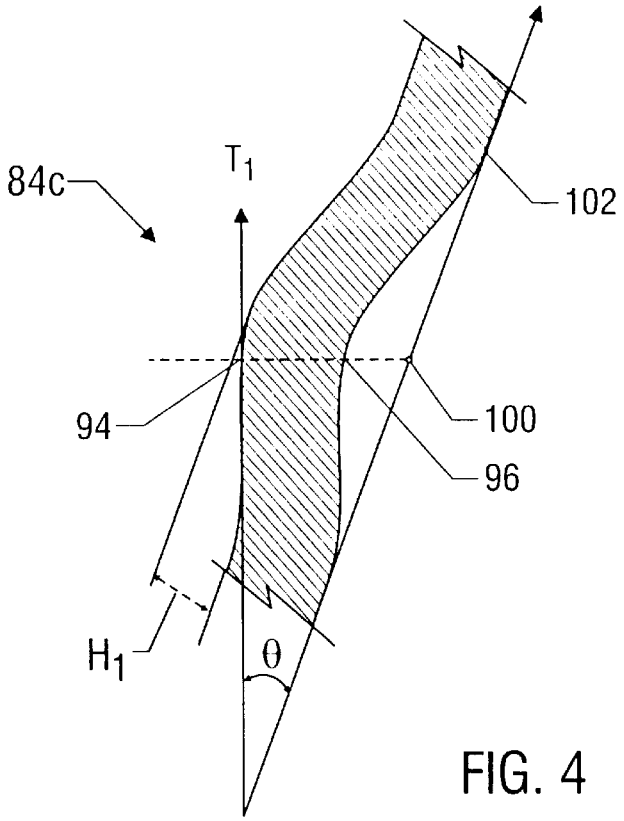
FIG. 4 is a cross-sectional view of the slat of FIG. 3 taken along the lines 4—4 showing an enlarged, detailed view of a protrusion.
Figure 5:
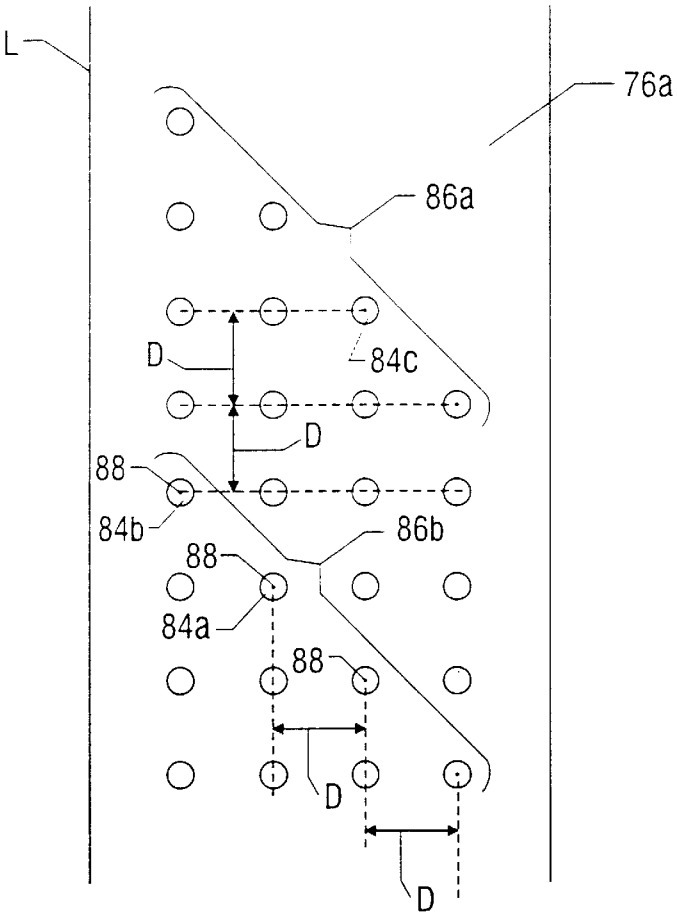
FIG. 5 is a fragmentary plan view of the slat of FIG. 3 showing an enlarged, detailed view of the protrusions.

With reference to FIG. 4, each protrusion 84*c* has an approximate height $H_1$ of 0.2 mm (±0.05 mm). The protrusion 84*c* has an upper surface 94 disposed so that an angle θ of 20° is formed between a line connecting the end point 96 on the surface 94 of the protrusion 84*c* of a radius 98 from a point 100 on a plane tangent to the lower surface 102 of the slat 76*a*. The angle θ was carefully chosen to be 20°, which is greater than the slant of 19.5° of the slat 76*a*, so that the exterior surface 90 of the protrusion 84*c*, as seen facing downward, is less than 90° , or less than vertical. In other words, a tangent $T_1$ to the upper surface 94 of the protrusion 84*c* facing downwardly is almost, but not quite, vertical. When the media 14 is comprised of sheets of paper, stalls and misfeeds are eliminated when the exterior surface 90 is less than vertical.

It will thus be appreciated from the above description that the leading edge 68 of a sheet 14 will engage only one protrusion 84 at a time as it is fed from the stack 16 of sheets 14. This is considered significant to the present invention, as it has been found that when the leading edge 68 of a sheet 14 engages multiple protrusions 84 at the same time, the sheet 14 stalls, causing misfeeds.

Figure 6:
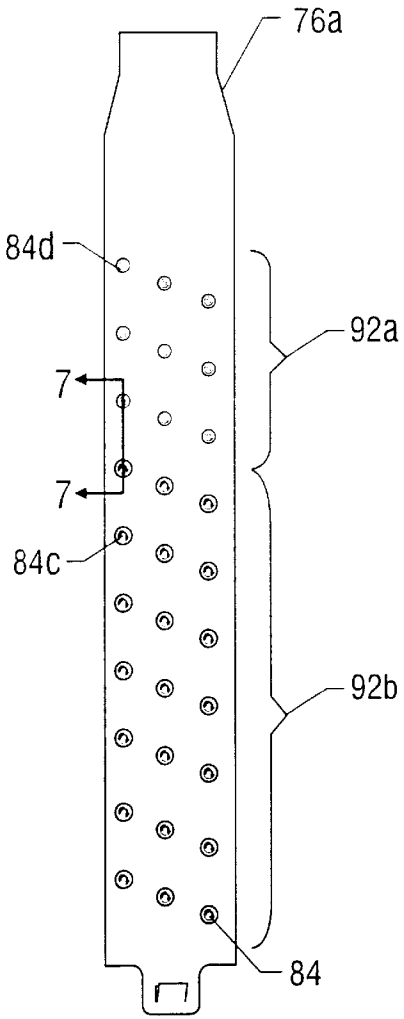
FIG. 6 is an enlarged plan view of a second type of slat inserted in the parallel ribs of the dam of FIG. 1.

Other arrangements of the protrusions 84 on the slats 76*a* have been used, depending upon the media of the sheets 14 and the depth of the tray 10. Turning now to FIG. 6, an alternative arrangement of protrusions 84 on the slat 76*a* is depicted in which each row 86 has three protrusions 84 rather than four as in FIG. 3. Three protrusions 84 were chosen for ease of visual recognition to distinguish the different slats 76*a* during assembly.

The protrusions 84 of the slat 76*a* are, unlike the protrusions 84 on FIG. 3, of two different sizes. One set 92*a* of protrusions 84*d* is of one size or height $H_2$, while a second set 92*b* of the protrusions 84*e* is of a different size or height $H_3$, where $H_2$ is less than $H_3$. In one embodiment, $H_2$ was 0.3 mm (±0.05 mm), while $H_3$ was 0.4 mm (±0.05 mm). The protrusions 84*d* comprising the first set 92*a* are located at the upper end of the slat 76*a*, and occupy approximately the upper one-third of the slat 76*a*. The protrusions 84*e* comprising the second set 92*b* occupy approximately the lower two-thirds of the slat 76*a*. It is to be appreciated that the diameters of the protrusions 84*d* are slightly smaller than the diameters of the protrusions 84*e*. It is to be further appreciated that, in the embodiment of FIGS. 6 and 7, the angles of the tangents $T_2$ and $T_3$ to the upper surface 94 are more than vertical, i.e., the tangents to the surface of the protrusions 84*d*, 84*e* facing downwardly form an angle with respect to the vertical. The angles of the tangents $T_2$ and $T_3$ to the upper surface 94 of the protrusions 84*d*, 84*e* are considered significant in insuring the correct feeding of the sheets 14 of media whereby the sheets 14 do not stall or misfeed.

Figure 7:
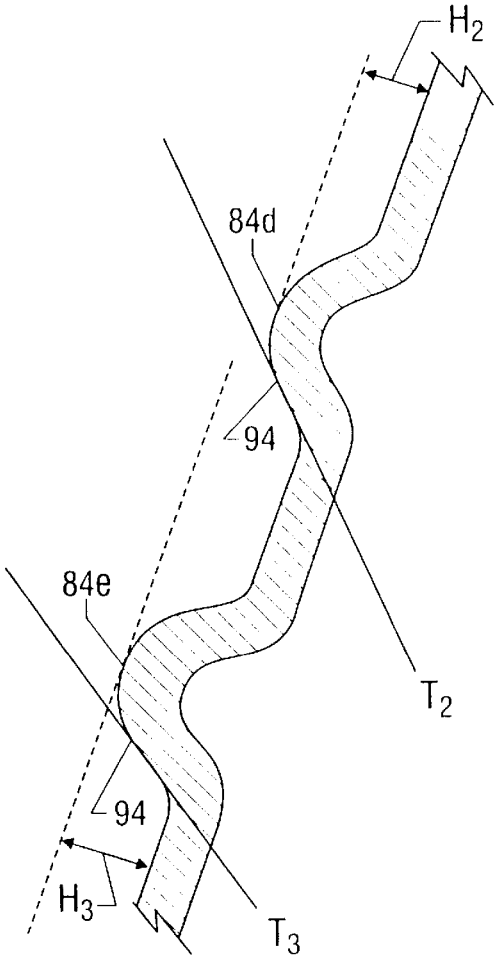
FIG. 7 is a cross-sectional view of the slat of FIG. 6 taken along the lines 7—7 showing an enlarged, detailed view of two different sizes of protrusions.

The slat 76*a* of FIGS. 6 and 7, with two sizes of protrusions 84*d*, 84*e*, is preferably used with the sheets 14 of media that are harder to separate and have greater buckling characteristics, such as vinyl labels. The slat 76*a* with the two sizes of protrusions 84*d*, 84*e* has been especially efficacious when used with vinyl labels that are imprecisely cut because the perforations were incised too deeply or were made with dull blades, causing the sheets to "nest," or stick together.

There is a normal force between the sheets 14 in the stack 16 that results from the action of the feed rollers 24, and the selection of the heights $H_2$, $H_3$ of the protrusions 84 is impacted thereby. The feed rollers 24, as noted hereinbefore, urge the top sheet 54 downward as well as forward into the dam 22 when feeding the top sheet 54 from the stack 16. The downward force of the feed rollers 24 has a horizontal normal component that is opposed to the feed direction F. If the horizontal normal component is greater than the restraining force imparted to the top sheet 54 when the top sheet 54 engages the protrusions 84 of the slat 76*a*, the top sheet 54 and the next adjacent sheet 104 will stick together, thus resulting in a double sheet feed. Since the normal force is greater when the height of the stack 16 of sheets 14 of media is smaller, and particularly when the media comprises imprecisely cut vinyl labels, the larger protrusions 84*e* at the bottom of the slat 76*a* overcome this additional normal force.

The slat 76*a* with two sizes of protrusions 84*d*, 84*e* has also been useful when employed in conjunction with a particularly deep tray 10 holding 500 sheets of ordinary thickness paper, as opposed to a tray 10 holding 250 sheets of ordinary thickness paper. It has been discovered that the horizontal component of the normal force resulting from the downward force of the feed rollers 24 upon the stack 16 of the sheets 14 of media, as discussed hereinbefore, is greater when there are fewer sheets 14 in the stack 16 in the 500 sheet tray than it is upon a corresponding stack 16 of sheets 14 in the 250 sheet tray. Hence, the use of the slat 76*a* with its consequent greater ability to separate sheets 14 of media with greater buckling characteristics has been found to be advantageous in such situations.

The protrusions 84 are preferably made with a punch and die machine, thus insuring relatively accurate and uniform sizes of the protrusions 84. Other suitable fabrication tools will be suggested to those of skill in the art.

When the top sheet 54 of the stack 16 (see FIG. 1) of the sheets 14 is advanced therefrom, the leading edge 68 (see FIG. 8) of the top sheet 54 initially engages the exterior surface 90 and the protrusions 84 of the slat 76*a* (see FIG. 3) one at a time.

Figure 8:
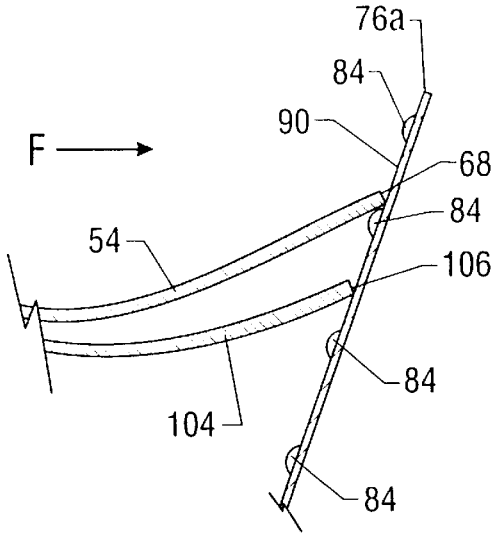
FIG. 8 is a cross-sectional view of the slat of FIG. 3 taken along the lines 8—8 showing an enlarged, detailed view of the protrusions and the sheets of media.
Figure 9:
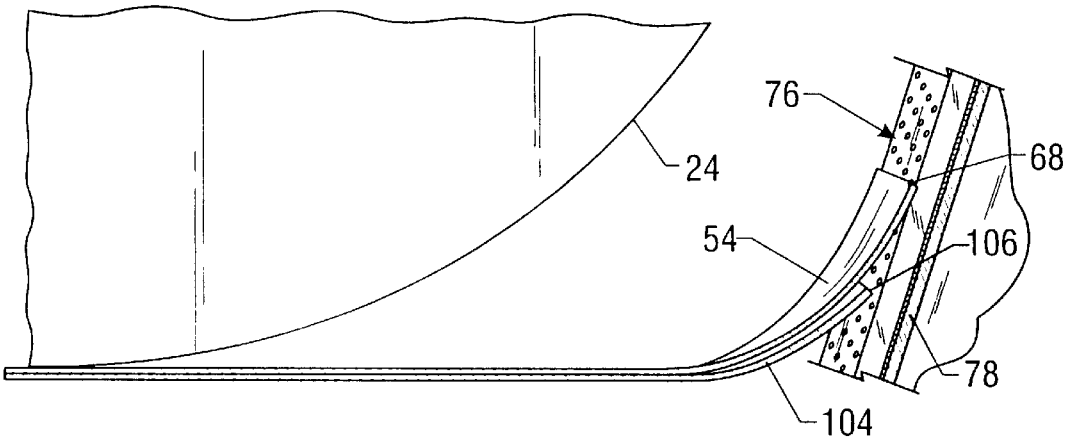
FIG. 9 is a schematic side elevational diagram showing one of the three possible relationships of two adjacent contacting sheets striking a slat surface, with the sheets shown enlarged for clarity purposes.

If a next adjacent sheet 104 in the stack 16 (see FIG. 1) also has been advanced from the stack 16 with the top sheet 54 (see FIGS. 8 and 9), its leading edge 106 also will have engaged the exterior surface 90 and the protrusions 84 of the slat 76*a*, and the leading edges 68, 106 thereof will momentarily halt or stop (see FIGS. 8 and 9.) This halting or stopping action of the leading edges 68, 106 is believed to cause the sheets 54, 104 to buckle and fan out (see FIG. 8), permitting air to pass therebetween and thereby space the sheets 54, 104 from each other. The upper sheet 54 then pulls away from the lower sheet 104 and continues to be advanced along the exterior surface 90 of the slat 76*a* after there has been separation of the two adjacent sheets 54, 104.

The lower sheet 104 consequently falls back into the stack 16 in the tray 10 by the action of gravity. The sheet 104 subsequently becomes the uppermost sheet 54 in the stack 16 and is next fed to the printing station by the feed rollers 24.

As schematically shown in FIG. 9, the leading edge 68 of the top sheet 54 can engage the exterior surface 90 before the leading edge 106 of the next adjacent sheet 104. It should be understood that the leading edge 106 of the next adjacent sheet 104 could engage the exterior surface 90 before the leading edge 68 of the top sheet 54 or both the leading edges 68 and 106 could simultaneously engage the exterior surface

90. Thus, there are three different possibilities of the leading edges 68 and 106 engaging the exterior surface 90, but each produces separation of the sheets 54, 104 due to the buckling and fanning actions of the protrusions 84 of the slat 76*a*.

It should be understood that the motor 28 (see FIG. 1) must produce a sufficient torque to overcome the friction forces incurred by one or more of the sheets 14 striking the exterior surface 90 and the protrusions 84 of the slat 76*a* and the exterior surfaces 90 of the slats 76.

It should be further understood that the protrusions 84 could be arranged in parallel lines 86 across multiple slats 76*a*. In such an instance, the slats 76*a* would have to be precisely disposed in the inclined surface 22 to maintain the precise distances D from one protrusion 84 to the next so that the leading edge 68 of the sheet 54 engages only a single protrusion 84 at a time.

While the sheet separator of the present invention has been shown and described as being used with a printer, it should be understood that the sheet separator of the present invention may be used with any apparatus feeding a sheet from a stack to a processing station, for example, in which only one sheet at a time is to be fed from the stack to the processing station.

An advantage of this invention is that is relatively inexpensive to manufacture, being made of a simple material such as stainless steel hammered with indentations or dimples. A further advantage of this invention is that it is very durable, especially if the slats are made of stainless steel. A still further advantage of the present invention is that it is easy to repair or replace if it malfunctions. An even further advantage of this invention is that it can be easily retrofitted to existing printers at low cost. Another additional advantage of this invention is that it can be used in a printer tray containing a large number of sheets of media.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. A sheet separator for separating adjacent sheets of media being fed from a stack of individual sheets comprising:

a rotatable sheet feed roller, a surface for supporting a bottom of said stack of sheets, and having a sheet dispensing end, an inclined element located adjacent said end of said surface for supporting, said inclined element being inclined at an obtuse angle to said stack of sheets and having an exterior surface, said stack having a top opposite said bottom, said sheet feed roller for contacting said top of said stack and being spaced away from said inclined element and being rotatable to move said sheets in a feed direction from said top of said stack into said inclined element, and a plurality of protrusions disposed along said exterior surface of said inclined element, said protrusions arranged in a line diagonal to said feed direction.

2. The sheet separator according to claim 1, wherein each of said sheets has a leading edge when fed from said stack; and wherein said protrusions are disposed a predetermined distance from each other on said inclined element whereby said leading edge of said sheets engages only a single protrusion at a time when said sheets are fed from said stack into said inclined element.

3. The sheet separator according to claim 1, and further comprising a plurality of lines of protrusions disposed along said exterior surface of said inclined element.

4. The sheet separator according to claim 3, wherein said lines of protrusions are parallel to each other.

5. The sheet separator according to claim 4, wherein said protrusions are evenly spaced along said diagonal lines.

6. The sheet separator according to claim 5, wherein said diagonal lines are evenly spaced along said exterior surface of said inclined element.

7. The sheet separator according to claim 6, wherein said diagonal lines are positioned on said inclined element a predetermined distance from each other whereby said protrusions are evenly spaced in a direction parallel to said feed direction.

8. The sheet separator according to claim 7, wherein each of said sheets has a leading edge when fed from said stack; and wherein said protrusions are disposed said predetermined distance from each other on said inclined element whereby said leading edge of said sheets engages only a single protrusion at a time when said sheets are fed from said stack into said inclined element.

9. The sheet separator according to claim 6, wherein each of said protrusions has a center; and wherein said centers of said protrusions are spaced a predetermined distance from each other.

10. The sheet separator according to claim 9, wherein each of said sheets has a leading edge when fed from said stack; and wherein said protrusions are disposed said predetermined distance from each other on said inclined element whereby said leading edge of said sheets engages only a single protrusion at a time when said sheets are fed from said stack into said inclined element.

11. The sheet separator according to claim 6, wherein said protrusions include a first set of protrusions having a first size, and a second set of protrusions having a second size, said second size being different than said first size.

12. The sheet separator according to claim 11, wherein all of said protrusions on each of said diagonal lines are of the same size.

13. The sheet separator according to claim 12, wherein said first size of said protrusions is larger than said second size of said protrusions.

14. The sheet separator according to claim 13, wherein each of said sheets has a leading edge when fed from said stack; and wherein said first set of protrusions is disposed on said inclined element below said second set, whereby said leading edge of said sheets engages said first set of protrusions before engaging said second set of protrusions when fed from said stack.

15. The sheet separator according to claim 14, wherein said inclined element has a length; and wherein said second set of protrusions is located along about the top one-third of said length of said inclined element.

16. The sheet separator according to claim 1, wherein there are four protrusions in said diagonal line.

17. The sheet separator according to claim 1, wherein there are three protrusions in said diagonal line.

18. The sheet separator according to claim 1, wherein each of said protrusions is substantially circular in cross-section.

19. The sheet separator according to claim 18, wherein said protrusions are from about 0.2 millimeters to about 0.4 millimeters in height.

20. The sheet separator according to claim 1, wherein each of said sheets has a leading edge when fed from said stack; and further comprising a slat disposed on said inclined element which engages said leading edge of said sheets when fed from said stack, and wherein said protrusions are disposed along said slat.

21. The sheet separator according to claim 20, and further comprising two protruding ribs disposed on said inclined element, and wherein said slat is disposed between said pair of protruding ribs.

22. The sheet separator according to claim 21, and further comprising a stack of individual sheets supported by said surface for supporting, said individual sheets being flexible to permit said sheets to contact said slat and said protrusions when two sheets are moved together from said stack by said feed roller, whereby said upper and lower sheets engage said protrusions to buckle and then separate from each other.

23. The sheet separator according to claim 22, wherein said slats are stainless steel.

24. In a sheet separator for separating adjacent sheets of media being fed from a stack of individual sheets, a rotatable sheet feed roller, a surface for supporting a bottom of said stack of sheets and having a sheet dispensing end, an inclined element located adjacent said end of said surface for supporting, said inclined element being inclined at an obtuse angle to said stack of sheets and having an exterior surface, said stack having a top opposite said bottom, said sheet feed roller for contacting said top of said stack and being spaced away from said inclined element and being rotatable to move said sheets from said top of said stack into said inclined element in a feed direction, the improvement comprising a plurality of protrusions disposed along said exterior surface of said inclined element, said protrusions arranged in a line diagonal to said feed direction.

25. The improvement of claim 24, wherein each of said sheets has a leading edge when fed from said stack; and wherein said protrusions are disposed a predetermined distance from each other on said inclined element whereby said leading edge of said sheets engages only a single protrusion at a time when said sheets are fed from said stack into said inclined element.

26. The improvement of claim 24, and further comprising a plurality of lines of protrusions disposed along said exterior surface of said inclined element.

27. The improvement of claim 26, wherein said lines of protrusions are parallel to each other.

28. The improvement of claim 27, wherein said protrusions are evenly spaced along said diagonal lines.

29. The improvement of claim 28, wherein said diagonal lines are evenly spaced along said exterior surface of said inclined element.

30. The improvement of claim 29, wherein said diagonal lines are positioned on said inclined element a predetermined distance from each other whereby said protrusions are evenly spaced in a direction parallel to said feed direction.

31. The improvement of claim 30, wherein each of said sheets has a leading edge when fed from said stack, and wherein said protrusions are disposed said predetermined distance from each other on said inclined element whereby said leading edge of said sheet engages only a single protrusion at a time when said sheets are fed from said stack into said inclined element.

32. The improvement of claim 29, wherein each of said protrusions has a center, and wherein said centers of said protrusions are spaced a predetermined distance from each other.

33. The improvement of claim 32, wherein each of said sheets has a leading edge when fed from said stack, and wherein said protrusions are disposed said predetermined distance from each other on said inclined element, whereby said leading edge of said sheets engages only a single protrusion at a time when said sheets are fed from said stack into said inclined element.

34. The improvement of claim 29, wherein said protrusions include a first set of protrusions having a first size, and a second set of protrusions having a second size, said second size being different than said first size.

35. The improvement of claim 34, wherein all of said protrusions on each of said diagonal lines are of the same size.

36. The improvement of claim 35, wherein said first size of said protrusions is larger than said second size of said protrusions.

37. The improvement of claim 36, wherein each of said sheets has a leading edge when fed from said stack, and wherein said first set of protrusions is disposed on said inclined element below said second set, whereby said leading edge of said sheets engages said first set of protrusions before engaging said second set of protrusions when fed from said stack.

38. The improvement of claim 37, wherein said inclined element has a length, and wherein said second set of protrusions is located along about the top one-third of said length of said inclined element.

39. The sheet separator according to claim 24, wherein there are four protrusions in said diagonal line.

40. The sheet separator according to claim 24, wherein there are three protrusions in said diagonal line.

41. The improvement of claim 24, wherein each of said protrusions is substantially circular in cross-section.

42. The improvement of claim 41, wherein said protrusions are about 0.2 millimeters to about 0.4 millimeters in height.

43. The improvement of claim 24, wherein each of said sheets has a leading edge when fed from said stack, and further comprising a slat disposed on said inclined element which engages said leading edge of said sheets when fed from said stack, and wherein said protrusions are disposed along said slat.

44. The improvement of claim 43, and further comprising two protruding ribs disposed on said inclined element, and wherein said slat is disposed between said pair of protruding ribs.

45. The improvement of claim 44, wherein said slats are stainless steel.

46. A sheet separator for separating adjacent sheets of media being fed in a feed direction from a stack of individual sheets, said sheets having a leading edge when fed from said stack, comprising:

a rotatable sheet feed roller, a surface for supporting a bottom of said stack of sheets, and having a sheet dispensing end, an inclined element located adjacent said sheet dispensing end of said surface for supporting, said inclined element being inclined at an obtuse angle to said stack of sheets, said stack having a top opposite said bottom, said sheet feed roller contacting said top of said stack and being spaced away from said inclined element and being rotatable to move said sheets from said top of said stack into said inclined element, said inclined element having a pair of protruding ribs, and a slat disposed between said pair of ribs with a plurality of protrusions positioned along an exterior surface thereof, said protrusions evenly arranged in a plurality of lines diagonal to said feed direction, whereby said leading edge of said sheets engages only a single protrusion at a time when said sheets are fed from said stack into said inclined element so that said sheets buckle and then separate from each other.

47. In a sheet separator for separating adjacent sheets of media being fed in a feed direction from a stack of individual sheets, said sheets having a leading edge when fed from said stack, a rotatable sheet feed roller, a surface for supporting a bottom of said stack of sheets and having a sheet dispensing end, an inclined element located adjacent said sheet dispensing end of said surface for supporting, said inclined element being inclined at an obtuse angle to said stack of sheets, said stack having a top opposite said bottom, said sheet feed roller contacting said top of said stack and being spaced away from said inclined element and being rotatable to move said sheets from said top of said stack into said inclined element, said inclined element having a pair of protruding ribs, said individual sheets being flexible when two sheets are moved together from said stack by said feed roller, the improvement comprising a slat with a plurality of protrusions positioned along an exterior surface thereof and disposed between said protruding ribs and engaging said leading edge of said upper sheet when said upper sheet is advanced, said protrusions evenly arranged in a plurality of lines diagonal to said feed direction, whereby said leading edge of said sheets engages only a single protrusion at a time when said sheets are fed from said stack into said inclined element so that said sheets buckle and then separate from each other.

48. A paper tray for containing a stack of sheets of media fed by a sheet feed roller comprising:

a surface for supporting a bottom of said stack of sheets, and having a sheet dispensing end, an inclined element located adjacent said end of said surface for supporting, said inclined element being inclined at an obtuse angle to said stack of sheets and having an exterior surface, said stack having a top opposite said bottom, said sheet feed roller for contacting said top of said stack and being spaced away from said inclined element and moving said sheets in a feed direction from said top of said stack into said inclined element, and a plurality of protrusions disposed along said exterior surface of said inclined element, said protrusions arranged in a line diagonal to said feed direction.

49. The paper tray of claim 48, wherein each of said sheets has a leading edge when fed from said stack, and wherein said protrusions are disposed a predetermined distance from each other on said inclined element whereby said leading edge of said sheet engages only a single protrusion at a time when said sheets are fed from said stack into said inclined element.

50. The paper tray of claim 48, and further comprising a plurality of lines of protrusions disposed along said exterior surface of said inclined element.

51. The paper tray of claim 50, wherein said lines of protrusions are parallel to each other.

52. The paper tray of claim 51, wherein said protrusions are evenly spaced along said diagonal lines.

53. The paper tray of claim 52, wherein said diagonal lines are evenly spaced along said exterior surface of said inclined element.

54. The paper tray of claim 53, wherein said diagonal lines are positioned on said inclined element a predetermined distance from each other whereby said protrusions are evenly spaced in a direction parallel to said feed direction.

55. The paper tray of claim 54, wherein each of said sheets has a leading edge when fed from said stack, and wherein said protrusions are disposed said predetermined distance from each other on said inclined element, whereby said leading edges of said sheets engage only a single protrusion at a time when said sheets are fed from said stack into said inclined element.

56. The paper tray of claim 55, wherein each of said protrusions has a center, and wherein said centers of said protrusions are spaced said predetermined distance from each other.

57. The paper tray of claim 56, wherein each of said sheets has a leading edge when fed from said stack, and wherein said protrusions are disposed at said predetermined distance from each other on said inclined element, whereby said leading edge of said sheets engages only a single protrusion at a time when said sheets are fed from said stack into said inclined element.

58. The paper tray of claim 57, wherein said plurality of protrusions include a first set of protrusions having a first size, and a second set of protrusions having a second size, said second size being different than said first size.

59. The paper tray of claim 58, wherein all of said protrusions on each of said diagonal lines are of the same size.

60. The paper tray of claim 59, wherein said first size of said protrusions is larger than said second size of said protrusions.

61. The paper tray of claim 60, wherein each of said sheets has a leading edge when fed from said stack, and wherein said first set of protrusions is disposed on said inclined element below said second set, whereby said leading edge of said sheets engages said first set of protrusions before engaging said second set of protrusions when fed from said stack.

62. The paper tray of claim 61, wherein said inclined element has a length, and wherein said second set of protrusions is located along about the top one-third of said length of said inclined element.

* * * * *